US009317014B2

(12) United States Patent
Briswalter et al.

(10) Patent No.: US 9,317,014 B2
(45) Date of Patent: Apr. 19, 2016

(54) DEVICE FOR THE ORIENTATION OF A SCREW-IN ELEMENT OF A TIMEPIECE

(71) Applicant: Omega SA, Bienne (CH)

(72) Inventors: Sebastien Briswalter, Pfetterhouse (FR); Daniel Knuchel, Biel (CH)

(73) Assignee: Omega SA, Bienne (CH)

( * ) Notice: Subject to any disclaimer, the term of this patent is extended or adjusted under 35 U.S.C. 154(b) by 0 days.

(21) Appl. No.: 14/426,829

(22) PCT Filed: Oct. 3, 2013

(86) PCT No.: PCT/EP2013/070650

§ 371 (c)(1),
(2) Date: Mar. 9, 2015

(87) PCT Pub. No.: WO2014/067743

PCT Pub. Date: May 8, 2014

(65) Prior Publication Data

US 2015/0241846 A1 Aug. 27, 2015

(30) Foreign Application Priority Data

Nov. 2, 2012 (EP) ..... 12191108

(51) Int. Cl.
*G04B 3/04* (2006.01)
*G04B 37/10* (2006.01)
*G04B 27/00* (2006.01)

(52) U.S. Cl.
CPC ..... *G04B 3/04* (2013.01); *G04B 27/002* (2013.01); *G04B 37/103* (2013.01)

(58) Field of Classification Search
CPC ..... G04B 3/001; G04B 3/041; G04B 3/046; G04B 3/048; G04B 37/10; G04B 37/103; G04B 37/106; G04B 3/04; G04B 27/002; G04B 27/02
USPC ..... 368/308, 319–321
See application file for complete search history.

(56) References Cited

U.S. PATENT DOCUMENTS 4,408,901 A * 10/1983 Gagnebin ..... 368/321
6,200,020 B1 * 3/2001 Rieben ..... 368/290

(Continued)

FOREIGN PATENT DOCUMENTS

EP 1 124 167 A1 8/2001
EP 1 411 401 A1 4/2004
EP 1 701 225 A1 9/2006

(Continued)

OTHER PUBLICATIONS

Machine translation of EP 1701225, retrieved from the internet Jul. 17, 2015.*
International Search Report issued Jan. 7, 2014 in PCT/EP2013/070650 Filed Oct. 3, 2013.

*Primary Examiner* — Vit W Miska
(74) *Attorney, Agent, or Firm* — Oblon, McClelland, Maier & Neustadt, L.L.P.

(57) ABSTRACT

An orientable screw-in element including a cap and a device adjusting angular orientation of the cap relative to a watch middle part. The device adjusting angular orientation of the cap includes a first part including a flat friction surface, a second part integral with the cap including a second flat friction surface and a return mechanism configured to rotate the cap integrally with the first part. The cap and first part are axially mobile in relation to each other between a first position in which the first flat friction surface and second flat friction surface are each pressed against each other by the return mechanism such that the cap rotates integrally with the first part, and a second position in which the first flat friction surface and second flat friction surface are not in contact, the cap therefore free to rotate about the rotational axis of the screw-in element.

15 Claims, 2 Drawing Sheets

(56) References Cited

U.S. PATENT DOCUMENTS

| | | | | |
|---|---|---|---|---|
| 6,974,248 | B2 * | 12/2005 | Damasko | 368/308 |
| 7,815,365 | B2 * | 10/2010 | Hiranuma et al. | 368/319 |
| 7,967,504 | B2 * | 6/2011 | Tschumi et al. | 368/308 |
| 2004/0130971 | A1 | 7/2004 | Ecoffet et al. | |
| 2007/0025190 | A1 * | 2/2007 | Cretin | 368/319 |

FOREIGN PATENT DOCUMENTS

| | | | |
|---|---|---|---|
| EP | 2 182 417 | A2 | 5/2010 |
| WO | WO 2012/168243 | A1 | 12/2012 |

* cited by examiner

DEVICE FOR THE ORIENTATION OF A SCREW-IN ELEMENT OF A TIMEPIECE

CROSS-REFERENCE TO RELATED APPLICATIONS

This is a National phase Application in the United States of International Patent Application PCT/EP2013/070650 filed Oct. 3, 2013 which claims priority on European patent application No. 12191108.5 filed on Nov. 2, 2012. The entire disclosure of the above patent applications are hereby incorporated by reference.

This invention concerns a device to adjust the orientation of screw-in elements for timepieces and more specifically for crowns comprising a motif or a logo on their external face and on which the motif may be oriented at will.

Screw-in crowns are commonly used to equip watches in order to improve the sealing of the winding or control stem of said watches. This type of crown has the particularity of being able to assume an unscrewed position in which the watch can be wound, set, etc. and a screwed position in which the crown is screwed in and locked on a tube driven or screwed into the middle part of a watch case in order to compress a sealing gasket, thereby improving the sealing of the watch. The screwed position is therefore that which corresponds to the normal position when the watch is worn and which is always more or less the same, with the exception of wear to the sealing gasket.

The manufacture and the mounting of these screw-in crowns on watch cases is well known. However, the methods of mounting these crowns are poorly suited to screw-in crowns whose outer face bears an inscription or motif, for example a logo, a manufacturing brand or a similar emblem. Indeed, the known mounting methods do not generally allow the crown to be brought into a determined orientation with regard to the case once screwed-in, which impairs the aesthetics of the case when an inscription is affixed to the outer face of the crown. This is of course unacceptable when the crowns are fitted to luxury and high quality goods.

To overcome these drawbacks in terms of the reliability of the orientation of a logo, EP Patent No 1411401 describes a specific crown comprising, on its external upper face, a substrate which is orientable in relation to a head formed by a central body and a lateral skirt, the substrate being provided with an inscription and being rotationally disengageable from the head of the crown when pressure is exerted against braking means. The drawback of this solution is that it requires, on the one hand, an unconventional crown structure wherein the orientable logo is not formed as a single piece with the head of the crown, on the other hand, this solution is not robust to shocks, which may exert a pressure force on the substrate and thereby reorient the crown in an undesired manner with regard to the body of the crown. Further, numerous precautions must be taken when manipulating the crown in order to avoid applying any pressure force towards the middle part of the case to prevent inadvertent rotation of the substrate, which makes the crown inconvenient to use.

Several other solutions have been proposed with more conventional crowns, including a hollow cap on an outer face of which the logo to be oriented is machined, and inside which the orientation device is arranged. According to EP Patent Application No 1124167A1 for example, a shape memory alloy ring is placed either between the middle part and a tube, or between the crown and a tube to adjust the crown to a determined orientation or position once it is screwed onto the tube. By adjusting the deformation of the ring, in particular by reducing its diameter by subjecting the watch to determined temperatures, temporary play may be created between the middle part and the tube, respectively between the crown and the tube, which allows for angular adjustment of the crown in its screwed position. A drawback of this solution lies in the additional space required for the ring, which must be taken into account in sizing the orientation device, and which determines the inevitably larger overall volume required for the crown in comparison with a standard crown. Also, shape memory alloys are not currently available in small sized bars, so that it is difficult and expensive to machine the rings in question in the small dimensions required for the applications concerned. Finally, this process is only intended for the initial mounting of the crown by the watch manufacturer, and not for subsequent crown orientation adjustment operations, which may damage other parts of the watch which are sensitive to variations in temperature.

EP Patent No 2182417 offers an alternative device for the orientation of screw-in crowns with a logoed cap comprising three tubes two of which are each orientable with regard to the other by means of toothings held in contact by means of a nut. This solution certainly allows for corrections to the setting of the crown orientation after initial mounting by unscrewing the nut, but proves to be particularly bulky as it requires a deeper aperture inside the crown for housing the nut. Further, the orientation adjustment cannot be carried out in a modular manner on the crown separate from the case, as certain indexation elements are integral to a tube screwed into the middle part.

EP Patent No 1701225 describes an orientable screw-in crown with a conventional cap featuring an inscription, and a head integral with a winding stem. The head and the cap are made to rotate integrally by means of truncated-cone surfaces held in mutual contact by means of an elastic element, and the angular position of the cap is adjusted by withdrawing the latter axially with regard to the middle part according to the longitudinal axis of the crown. Given that the integral rotation of the cap and head is achieved only by friction forces between the truncated-cone surfaces, these surfaces must cover a very large area to ensure that the cap is held, particularly when the compression forces exerted by the elastic element progressively are reduced over the life of the watch on which the crown is mounted. This solution is therefore not suitable for crowns of small size or of reduced height.

It is an object of the present invention to overcome the drawbacks of the prior art by providing a device for the orientation of screw-in elements such as a traditional crown of simple and economic construction, comprising a motif such as a logo or a trademark and wherein the position of the logo or the trademark affixed to the outer face of said element can easily be adjusted in a determined position or orientation and whose size can be reduced.

To this end, the invention concerns an orientable screw-in element including a cap formed by a cover integral with a lateral skirt and a device to adjust the angular orientation of the cap in relation to the middle part of a watch, characterized in that the angular orientation adjustment device comprises a first part provided with a first flat friction surface, a second part integral with the cap provided with a second flat friction surface and return means intended to make said cap rotate integrally with the first part. The cap and the first part are axially mobile in relation to each other between a first position in which the first flat friction surface and the second flat friction surface are each pressed against each other by the return means, and a second position in which the first flat friction surface and the second flat friction surface are no longer in contact. The return means and the first and second friction surfaces are arranged such that the cap rotates integrally with the first part in said first position, and is free to rotate about the rotational axis of the orientable screw-in element in the second position.

The advantage of the cooperation of the flat friction surfaces, although not natural for those skilled in the art due to the reduction in contact surfaces involved, is that it gives the screw-in element the advantage of compactness. This solution is therefore particularly well suited to very small sized parts.

According to a preferred embodiment, the direction and intensity of the forces exerted by the return means are determined in such a way that the adjustment can only be made by the manufacturer during assembly or, for example, during servicing, but not by the actual user of the watch, without the assistance of a tool. Thus, any error in manipulation and/or any undesired change in orientation, following a shock for example, can be avoided.

Other features and advantages of the present invention will appear more clearly from the following detailed description of a preferred embodiment, given by way of non-limiting example, with reference to the annexed drawings, in which.

Figure 1:
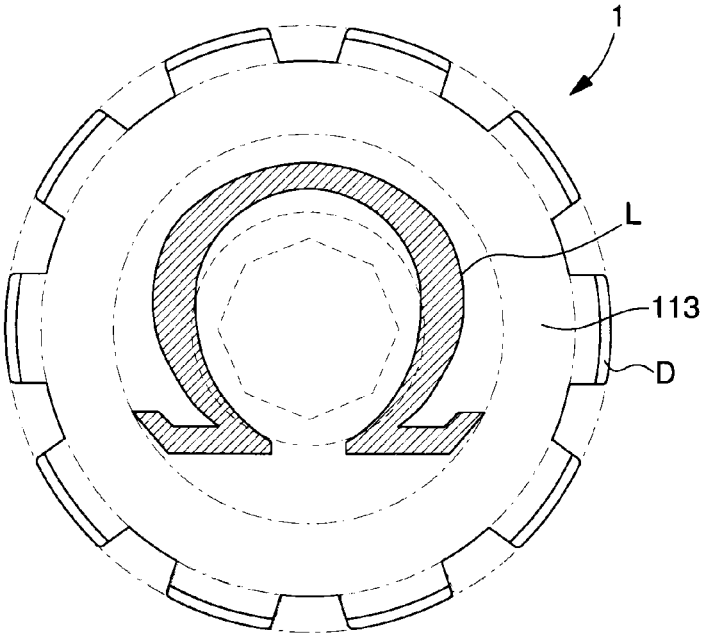
FIG. 1 shows a top view of a screw-in element in the form of an orientable crown, with a logo on the outer face of the cap cover.

In the preferred embodiment illustrated in all the Figures that follow, the orientable screw-in element consists of a crown designated by the general reference 1. In FIG. 1, which is a top view of crown 1, the logo L "Omega" of the Applicant can be seen, positioned on the outer face 113 of cover 112 of cap 11, inside which is housed an orientation adjustment device described below with reference to FIGS. 2 to 4. For aesthetic reasons, this logo L is adjusted in a perfectly horizontal position preferably corresponding to a plane of the middle part of the watch on which the crown is mounted. This Figure also shows, on the external periphery of the cap, a toothing D which is intended to improve the user's grip on crown 1 during use.

Figure 2:
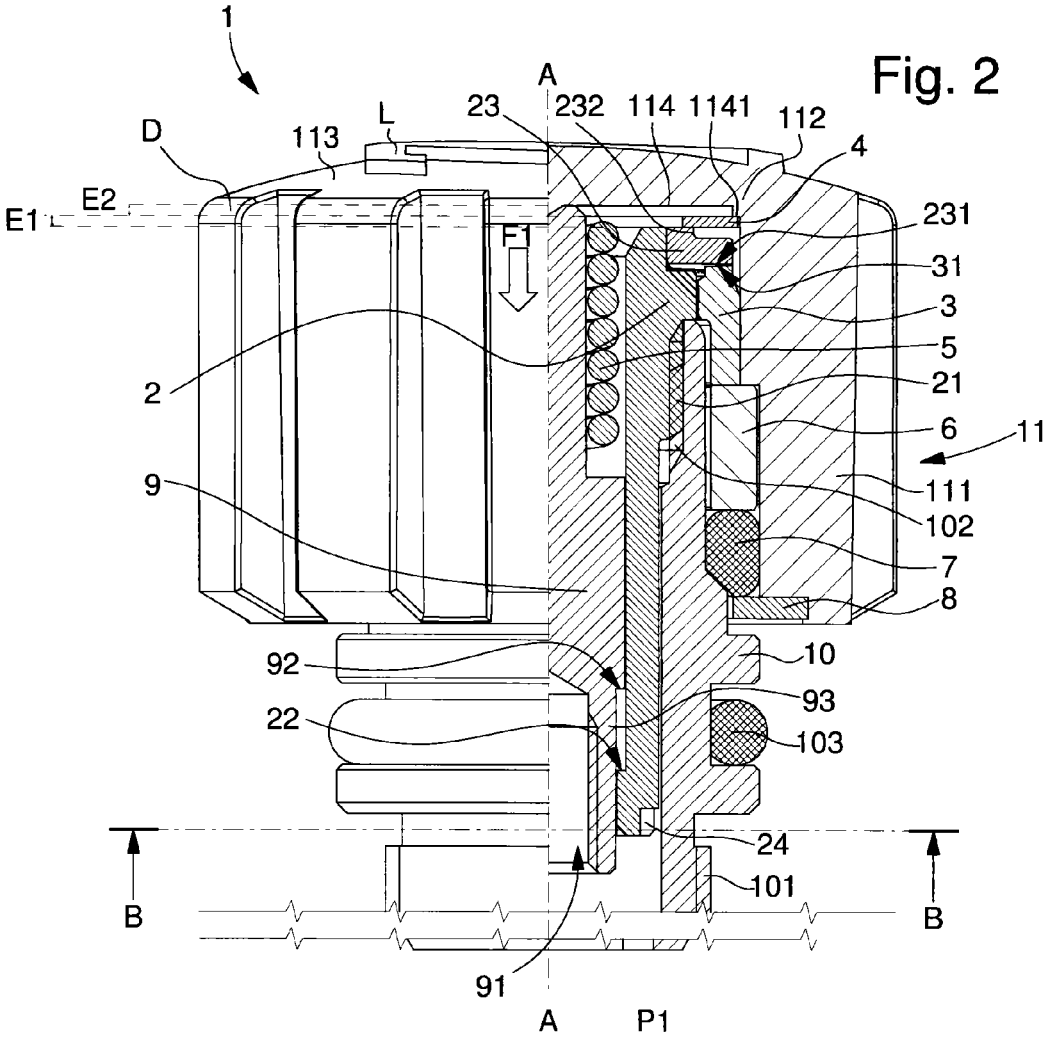
FIG. 2 shows a semi cross-section of the orientable crown of FIG. 1 fitted with an orientation adjustment device according to a preferential embodiment of the invention, at rest.

FIG. 2 is a sagittal cross-section view along the rotational axis A-A of the crown, which reveals the orientation adjustment mechanism according to the preferred embodiment of the invention. Crown 1 is shown in the screwed-in position on a threaded tube 10, intended to be screwed into the middle part of a watch case (not shown) by means of a first external thread 101, while an internal thread 102 cooperates with the external thread 21 of a central pipe 2 of tubular shape. According to an alternative embodiment, the internal thread 102 of tube 10 may also consist of a second external thread and the external thread 21 of central pipe 2 may equally consist of an internal thread, as for a conventional crown screwed directly onto the tube. A first gasket 103 is intended to be arranged between the tube 10 and the middle part for sealing purposes.

Figure 3:
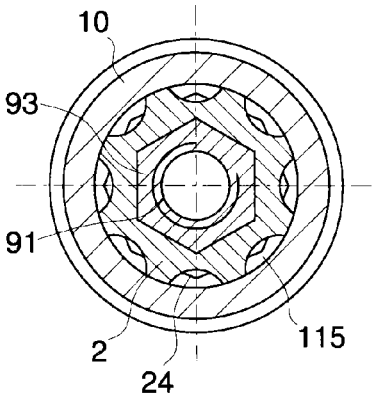
FIG. 3 shows a bottom view of the orientable crown of FIG. 1 showing more specifically the external sections of a piston and a pipe.

Cap 11 is formed by a cover 112 and an axial skirt 111, which together define a central aperture 115 inside the crown forming screw-in element 1—referenced only in FIG. 3 for the sake of readability—and in which there is arranged not only the end of threaded tube 10 integral with the middle part, but also central pipe 2. According to the preferred embodiment illustrated, the central threaded pipe 2 consists of an intermediate element between cap 11 of crown 1 and the middle part of the watch as well as a stem (not represented but mounted in a conventional manner on the lower end 93 of the piston 9 via an internal thread 91 in a blind hole) interacting with the movement. In the screwed in position on tube 10, the orientation of central pipe 2 is always identical in relation to tube 10, and consequently by transitivity to the middle part, in which the latter is also screwed via first external thread 101. It is therefore the relative orientation of central pipe 2 in relation to cap 11 of crown 1, that determines the orientation of the motif or logo L inscribed on the upper face 113 of its cover 112. This orientation of central pipe 2 can be determined by adjusting the gearing notches 24, provided for this purpose and arranged on the lower part thereof and a preferred form of which is illustrated in FIG. 3 described hereafter.

Figure 4:
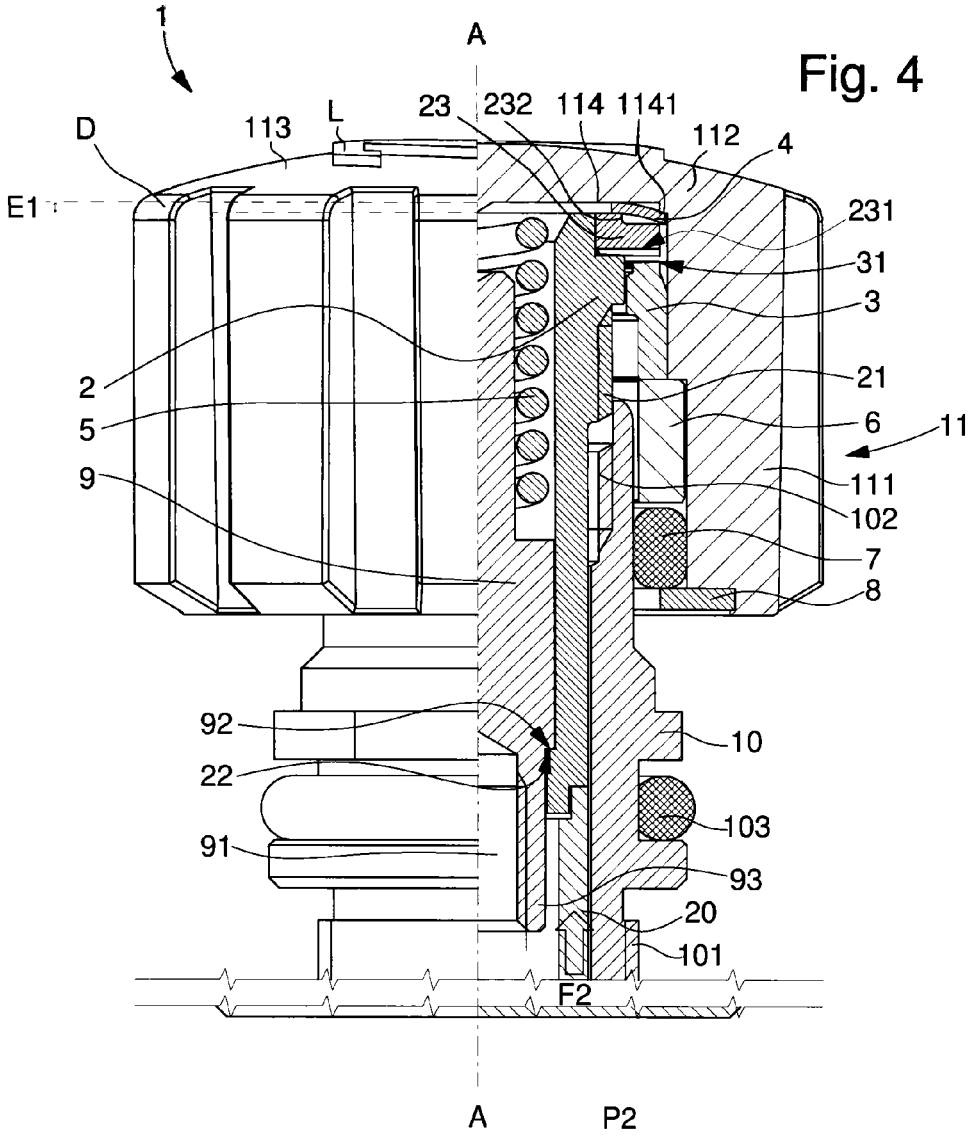
FIG. 4 is a similar cross-section to FIG. 2, the crown being represented in a position wherein the cap is detached from the head to allow for angular orientation of the motif on the cap into a determined position, in a position detached from the middle part.

The relative axial position of the central pipe 2 is variable in relation to cap 11, and respectively determines an adjustment mode and a locked mode for the orientation of crown 1. The locked mode for the angular orientation of cap 11, referenced P1, is illustrated in FIG. 2, whilst the angular orientation adjustment mode for cap 11, referenced P2, is illustrated in FIG. 4 described hereafter.

Piston 9 housed inside central pipe 2 can slide against a spring 5 stopped on an inner surface 114 of cover 112 of cap 11, and, in particular, enables cap 11 to emerge from the middle part when crown 1 is unscrewed from tube 2 when crown 1 is used to set a function (for example, to set the time, adjust the date or manually wind the movement). The axial travel of piston 9 along axis of rotation A-A of crown 1 is limited by a stop member 22 positioned at the bottom of central pipe 2, on which is positioned a first shoulder 92 of the piston 9. Piston 9 reaches the end of its travel when crown 1 is unscrewed from tube 10, as illustrated in FIG. 4 described hereafter. A second sealing gasket 7, typically an O-ring joint, is inserted between threaded tube 10 and axial skirt 111 of cap 11 so as to guarantee sealing with respect to the internal elements of the crown; in the screwed-in position of the crown, this second sealing gasket 7 is axially held between a first ring 6, also referred to as spacer, and a second ring 8, also commonly referred to as a deck ring, which covers the gasket on the lower surface of crown 1. This second gasket 7 is compressed on a portion of tube 10, as shown in FIG. 1. Alternatively, the two holding rings 6 and 8 for second gasket 7 could be replaced by an annular groove arranged in axial skirt 111 of cap 11 and directed towards threaded tube 10.

According to the invention, cap 11 is assembled on central pipe 2 so that they usually rotate integrally, as in locking or rest position P1 illustrated in FIG. 2, this assembly is achieved in a removable or reversible manner. This integral rotation is obtained by via first and second flat friction surfaces 231, 31 preferably positioned on annular wear parts mounted respectively on central pipe 2 and cap 11 of the crown, such as, for example, a collar 23 fixed at the upper end of central pipe 2 and an annular orientation part 3 fixed inside cap 11 for example by welding, crimping or any other appropriate means. The collar 23 of central pipe 2 and annular orientation part 3 thus form a preferred embodiment for the first part and the second part integral with cap 11 of crown 1 on which the friction surfaces are positioned in mutual contact. The advantage of choosing wear parts for arranging first and second flat friction surfaces 231, 31 is twofold: on the one hand, it makes it possible to choose different materials from those of cap 11 and of central pipe 2 for collar 23 and orientation part 3, with better tribological properties (such as, for example, a composite material, a mixture of a metallic alloy and a ceramic, of the "dual matrix composite" (DMC) type having particularly high friction coefficients), and on the other hand, this modular construction makes it possible to replace only the required sections of parts worn by friction during service or repairs.

Separate return means from those associated with the extension of the piston are intended to cause cap 11 and central pipe 2 to rotate integrally by exerting a compression force F1 between collar 23 and orientation ring 3, and thereby hold first and second friction surface 231, 31 in mutual contact in locking position P1. According to the preferred embodiment illustrated, the return means consist of a flat spring 4, of a thickness e1 of no more than 0.2 mm, arranged between a second shoulder 232 positioned on the collar and the third shoulder 1141 of a substantially flat internal surface 114 of cover 111. The depth e2 of third shoulder 1141 makes it possible to define a maximum axial travel of central pipe 2 on which collar 23 is fixed, whilst second shoulder 232 positioned on collar 23 provides a greater lever arm for the flat spring and thereby allows it to deform more easily. The width of the shoulder makes it possible to adjust the lever arm and thereby adjust the force to be applied to release the first and second friction surface 31, 231 from each other. The height of the space required inside the crown for such return means is therefore equal to a maximum of 0.4 mm, which is far smaller than with ordinary elastic springs, such as, for example, a curved spring. To reduce the height even further, it is also possible to arrange the second flat friction surface 31 not on a specific part such as annular orientation part 3 but directly on the upper surface of the spacer, that is to say the first ring 6.

According to the illustrated embodiment, the force F1 exerted by the return means acts in the direction of the rotational axis A-A, downwards, which would correspond to the inside of the middle for a crown in the mounted position. This orientation of force F1 makes it impossible for the user to change the orientation of crown 1 as he can only act on cap 11 and therefore never generate a force F2 intended to remove central pipe 2 from tube 10, as explained hereafter in light of FIG. 4.

According to the preferred embodiment illustrated in FIG. 2, the force F1 exerted by the return means is exerted along the direction of rotational axis A-A, which is vertical, whilst the first and second friction surface 231, 31 are arranged on a horizontal plane. Such an arrangement makes it possible to maximise the mutual pressing force between the surfaces and consequently tends to keep the rotation of cap 11 integral with the one of the central pipe 2, which depends only on the friction forces between the friction surfaces. Since the intensity of the friction forces depends directly on the magnitude of the reaction to the force exerted by return means F1, this intensity will be all the greater when said force is exerted in a direction normal to the friction surfaces. Consequently, more generally within the scope of this invention, the return elements could preferably by arranged so that they exert a friction force in a perpendicular direction to the contact plane between the first and second friction surfaces 231, 31.

FIG. 3 shows a bottom view of the crown along the cross-sectional axis B-B illustrated in FIG. 2. The peripheral portion of this Figure shows the central aperture 115 of crown 1 in which the threaded tube 10 is engaged, whilst the lower end of central pipe 2 can be distinguished, having an aperture of hexagonal section. This aperture is intended to cooperate with the lower end of piston 93, inside which the internal thread 91 for connection with a stem (not shown) can be seen interacting with the movement. In this case, the lower end of piston 93 also assumes a hexagonal shape of corresponding size, so that central pipe 2 and piston 9 usually rotate integrally at least in the crown orientation adjustment position P2. The arrangement of a specific hexagonal section makes it easy to manipulate the angular orientation of central pipe 2 when the crown is unscrewed from tube 10, as shown in FIG. 4 described in the following paragraph, with a tool such as a traditional hex key. Other sections for the aperture made in the base of the central pipe, of a square or triangular type for example, can also be envisaged for carrying out this manipulation, according to the preferred tool. Due to the torsion constraints between piston 9 and central pipe 2 during direct action on piston 9 to adjust the angular orientation of crown 1, the preferred embodiment describes the arrangement of gearing notches 24 on the lower periphery of central pipe 2 for the rotational driving thereof by means of a key with correspondingly shaped teeth engaged in the notches. The number of notches and their depth depends on the moment of torsion required to be applied to the pipe, eight can be seen in FIG. 3.

FIG. 4 shows crown 1 of FIG. 2 in adjustment position P2 as the return means used, here flat spring 4, are compressed by the application of a force F2, in the opposite direction to force F1, using a key 20 engaged in gearing notches 24 of central pipe 2 so that first and second flat friction surfaces 231, 31 are not in mutual contact. The axial travel of central pipe 2 is determined by the depth e2 of third shoulder 1141 on the internal surface of cover 114, which is several tenths of a millimeter. All the parts shown in FIG. 4 are identical to those in FIG. 2. However, it can be seen that, unlike in FIG. 2, the spring 5 of piston 9 can extend since there is no longer any axial stress either from the external thread 21 for the position of cap 11 or from the indexed position of the winding stem on which piston 9 is intended to be mounted. It can be seen however that it is not the compressed or extended position of spring 5 of piston 9 that determines whether the crown is in locking position P1 or orientation adjustment position P2, this position being defined only by the position of return means 4.

According to a preferred embodiment, the flat spring 4 is determined so that the change from position P1 to position P2 requires a force F2 to be exerted against return means 4 having an intensity two times greater than the force F1 exerted by the return means at rest, that is to say in locking position P1, so as to exclude any a chance error in manipulation for the orientation of crown 1. In the event that the force F1 exerted by flat spring 4 is of 14 Newtons, which is considerably greater than the force required to change the axial position of a standard setting lever, which is generally far less than ten Newtons, the plastic properties of flat spring 4 could be configured such that a force of 28 Newtons is required to adjust the orientation of crown 1. In order to slightly reduce the value of the required force F2, to obtain an intensity of between 23 and 28 Newtons and therefore facilitate manipulation of the crown during adjustment operations it is also possible to perforate flat spring 4. In one variant, the return element may consist of a flat spring no longer made of an elastic material, but from a shape memory alloy (SMA), the consequence of which would be to replace return force F2 by a temperature gradient to release the rotational locking connection. In this case the transition temperature should be well below the usual operating temperatures, and preferably thirty degrees lower.

It may be noted that according to a preferred embodiment described in FIGS. 2 and 4, it is impossible for the user to make an adjustment once crown 1 is assembled with tube 2. Indeed, the arrangement of first friction surface 231 on the internal face of collar 23 and the exertion of force F1 inwards prevents, on the one hand, any separation of cap 11 from central pipe 2 when the user pulls cap 11 to move crown 1 axially outside the middle part, since the movement of cap 11 in this direction presses the friction surfaces against each other. On the other hand, pressing cap 11 towards the middle part will not separate the friction surfaces from each other either: if crown 1 is not in its proximal position in relation to the middle part, that is to say the closest possible axial position to the middle part, the return means can in this case be compressed, but the force to be exerted to separate the toothings would have to be far greater than that which returns cap 11 to its proximal position in relation to the middle part by driving the winding stem. The cap would therefore first be returned to its proximal position, before the friction surfaces could be separated. In this position, no further axial movement is possible towards the interior of the middle part except by screwing tube 10, and the return means can no longer be compressed in order to allow the friction surfaces to disengage. In this manner, any error in manipulation is prevented and the orientation of the crown can only be changed when it is unscrewed from tube 2 and a tool is used, such as, for example, a key 20 on gearing notches 24, by applying a force F2 required to detach cap 11 and then the torsion moment to adjust the angular position of central pipe 2 in relation to cap 11.

As regards the return means, the embodiment described with reference to the Figures and the flat elastic spring 4 or a shape memory spring, has the advantage of only requiring a limited space between the upper surface of central pipe 2 and the internal surface of cover 114 in central aperture 115, equal to the sum of the thickness e1 of flat spring 4 and the depth of shoulder e2 of the internal surface of cover 1141. Although a minimal clearance must be arranged to ensure the possibility of axial displacement of central pipe 2 in relation to cap 11, other types of return means are possible, for example magnetized surfaces in proximity to the friction surfaces, such as, for example, part of collar 23 and part of annular orientation part 3, or even merged with the first and second friction surfaces 231, 31 machined in a ferromagnetic material. The use of magnetic return means has the advantage of making it possible to forgo the use of an additional dedicated part, which allows for an additional reduction in the volume of crown 1, in particular a saving in height equal to the thickness e1 of flat spring 4, and therefore further increases the overall compactness of the system. However, the use of magnetic friction surfaces can be employed not only as an alternative to a flat spring, but as a complementary measure in order to increase return force F1 to the rest position where cap 11 of crown 1 is integral with central pipe 2, and thereby to improve the friction forces without needing to increase the contact surfaces.

It will be noted that the use of a cap 11 arranged on central pipe 2 allows the crown manufacturer to have a stock of such pipes and to use them with different caps 11 bearing different motifs or other elements such as precious stones or similar, or with non-cylindrical external shapes such as squares or ovals or any other specific geometric shape.

Although the claimed invention has been mainly described in relation to the non-limiting example of a crown 1, it is understood that the screw-in element claimed may also consist for example of a manual or automatic valve, a pushbutton, a corrector or even an orientable back cover.

The invention claimed is:

1. An orientable screw-in element comprising:

a cap formed of a cover integral with a lateral skirt; and a device to adjust angular orientation of the cap relative to a watch middle part, wherein the device to adjust angular orientation of the cap includes a first part including a first flat friction surface, a second part integral with the cap including a second flat friction surface, and a return mechanism configured to cause the cap to rotate integrally with the first part, the cap and the first part being axially movable in relation to each other between a first position in which the first flat friction surface and the second flat friction surface are each pressed against each other by the return mechanism, and a second position, in which the first flat friction surface and the second flat friction surface are no longer in contact, wherein the first and second friction surfaces are arranged such that the cap rotates integrally with the first part in the first position and is free to rotate about the axis of rotation of the orientable screw-in element in the second position, and wherein the first part and the cover are farther apart from one another in the first position than in the second position.

2. The orientable screw-in element according to claim 1, wherein the cover and the lateral skirt define a central aperture arranged to house a central pipe connected to the first part.

3. The orientable screw-in element according to claim 1, wherein the first part including the first flat friction surface forms an interchangeable wear collar around a central pipe.

4. The orientable screw-in element according to claim 1, wherein the second part integral with the cap including the second flat friction surface is an interchangeable annular orientation wear part.

5. The orientable screw-in element according to claim 1, wherein the return mechanism exerts an inwardly oriented axial force along the axis of rotation of the screw-in element.

6. The orientable screw-in element according to claim 5, wherein the first and second friction surfaces are arranged in a horizontal plane.

7. The orientable screw-in element according to claim 6, wherein the return mechanism includes a flat elastic spring.

8. The orientable screw-in element according to claim 7, wherein the flat spring has a maximum thickness of 0.1 mm and is arranged between a first shoulder of an internal surface of the cover of the cap and a second shoulder of a first piece, the shoulder having a maximum depth of 0.2 mm.

9. The orientable screw-in element according to claim 5, wherein the first and second friction surfaces are magnetized.

10. The orientable screw-in element according to claim 1, further comprising a piston connected to a stem connected to a watch movement, the piston being housed in a central pipe and arranged to be movable inside the central pipe, travel of the piston being limited by a stop member of the central pipe.

11. The orientable screw-in element according to claim 10, wherein the piston has a lower end of hexagonal shape and the central pipe has a correspondingly shaped aperture.

12. The orientable screw-in element according to according to claim 10, wherein the central pipe includes peripheral gearing notches for orientation adjustment.

13. The orientable screw-in element according to claim 1, wherein a change from position to position requires exertion of a force against the return mechanism with an intensity between 23 and 28 Newtons.

14. The orientable screw-in element according to claim 6, wherein the return mechanism includes a shape memory spring.

15. An orientable screw-in element comprising:

a cap formed of a cover integral with a lateral skirt; and a device to adjust angular orientation of the cap relative to a watch middle part, wherein the device to adjust angular orientation of the cap includes a first part including a first flat friction surface, a second part integral with the cap including a second flat friction surface, and return mechanism configured to cause the cap to rotate integrally with the first part, the cap and the first part being axially movable in relation to each other between a first position in which the first flat friction surface and the second flat friction surface are each pressed against each other by the return mechanism, and a second position, in which the first flat friction surface and the second flat friction surface are no longer in contact, wherein the first and second friction surfaces are arranged such that the cap rotates integrally with the first part in the first position and is free to rotate about the axis of rotation of the orientable screw-in element in the second position, and wherein the first and second friction surfaces are magnetized.

* * * * *